United States Patent [19]

Ouwerkerk et al.

[11] Patent Number: 4,521,117

[45] Date of Patent: Jun. 4, 1985

[54] ARRANGEMENT FOR MIXING A GAS INTO A MAIN FLOW OF A SECOND GAS

[75] Inventors: Johannes H. W. Ouwerkerk, Driehuis; Wouter B. Lucieer, Schagen; Rudolph E. Cramer, Oudkarspel, all of Netherlands

[73] Assignee: Hoogovens Groep B.V., Ijmuiden, Netherlands

[21] Appl. No.: 578,846

[22] Filed: Feb. 10, 1984

[30] Foreign Application Priority Data

Feb. 17, 1983 [NL] Netherlands ..... 8300590

[51] Int. Cl.[3] ..... B01F 3/03

[52] U.S. Cl. ..... 366/165; 366/173; 366/177; 137/896

[58] Field of Search ..... 48/180.1, 189.1; 137/561 A, 808, 809, 896, 897; 261/79 A, 115; 366/150, 161, 162, 165, 167, 173, 174, 177, 341

[56] References Cited

U.S. PATENT DOCUMENTS

| | | | |
|---|---|---|---|
| 3,015,554 | 1/1962 | Rummel | 366/165 X |
| 3,913,617 | 10/1975 | van Laar et al. | 137/896 X |
| 4,054,424 | 10/1977 | Staudinger et al. | 261/79 A X |
| 4,150,817 | 4/1979 | Regelin et al. | 137/896 X |
| 4,390,346 | 6/1983 | Cramer et al. | 137/896 X |

FOREIGN PATENT DOCUMENTS

| | | |
|---|---|---|
| 0060634 | 9/1982 | European Pat. Off. . |
| 2206971 | 6/1974 | France . |

*Primary Examiner*—Robert W. Jenkins
*Assistant Examiner*—Arthur D. Dahlberg
*Attorney, Agent, or Firm*—Stevens, Davis Miller & Mosher

[57] ABSTRACT

In an arrangement for mixing a first gas into a main flow of a second gas, comprising a main conduit for said main flow and a plurality of supply conduits for the first gas which open into said main conduit, the supply conduits are arranged as at least one set of three outlet openings. This set consists of a first opening which opens into the main flow perpendicularly to the main conduit wall and two second openings which are arranged so as each to provide a lesser flow rate of the first gas than the first opening and are offset with respect to the first opening. The three openings of the set thus direct the first gas into two contra-rotating circulatory movements, as viewed in the direction of the axis of the main conduit. This mixing arrangement is applicable for example to mixing a hot gas into the gas obtained from an ore pellet drying bed and to mixing a hot gas into a water-laden gas from a desulphurization plant.

6 Claims, 8 Drawing Figures

ARRANGEMENT FOR MIXING A GAS INTO A MAIN FLOW OF A SECOND GAS

BACKGROUND OF THE INVENTION

1. Field of the Invention

This invention relates to a conduit arrangement for mixing a first gas into a main flow of a second gas, and to a conduit system including such an arrangement. The mixing arrangement has a main conduit for said main flow and a plurality of supply conduits for the first gas which debouch into said main conduit.

2. Description of the Prior Art

Canadian Pat. No. 1106181 describes (FIG. 1) a mixing arrangement of the above-described type in which the number of supply conduits for the gas being admixed is two. These conduits protrude radially through the wall of the cylindrically shaped main conduit and lie in a plane at right angles to the axis of the main conduit. In the main conduit, they are bent through an angle of about 30° in the same sense, and each has a round opening at its extremity, with the mutually parallel center lines of these openings having a separation less than half the internal diameter of the main conduit. Thus the gas being admixed is directed from the openings in mutually parallel but opposite directions with respect to the main conduit axis and circulates in a vortex around the axis in a single direction. This construction makes it possible to achieve complete mixing of the two gases within a short distance downstream from the point of introduction. U.S. Pat. No. 4,390,346, ES-A No. 491321 and EP-A No. 19325 have the same disclosure, as does Japanese patent application No. 60794/80.

U.S. Pat. No. 4,150,817 discloses a different mixing system in which similarly a single vortex is created by two supply conduits which open at the wall of the main conduit. FR-A-No. 2206971 shows a mixing arrangement in which twelve supply conduits open at circumferentially spaced points around the main conduit.

SUMMARY OF THE INVENTION

The object of the present invention is to provide a gas mixing arrangement in which complete mixing of the gases is achieved in a very short distance from the region of introduction of the admixed gas into the main flow. A short mixing distance is important in large industrial installations where each saving in investment and in space is important. It may also be desirable in some circumstances to obtain the mixing of both gases as rapidly as possible in order for example to smooth out concentration or temperature differences. The gas mixing arrangement according to the invention has supply conduits which provide at least one set of three outlet openings of which a first one, which has a larger flow rate than the other two (preferably half the total flow rate of admixed gas), opens generally perpendicularly to the main conduit wall while the other two openings of the set are offset or non-radial with respect to the first one so that the three openings cooperate to direct the admitted gas into two mutually contra-rotating circulatory movements or vortices within the main conduit, as seen looking axially along the main conduit.

A plurality of such sets of three openings may provide more than two such contra-rotating circulatory movements.

In this way, high efficiency of mixing of the admixed gas with the main flow of gas is achieved and the mixing distance can be extremely short.

BRIEF INTRODUCTION OF THE DRAWINGS

Preferred embodiments of the invention will now be described by way of non-limitative example with reference to the accompanying drawings, in which.

DESCRIPTION OF THE PREFERRED EMBODIMENTS

Figure 1:
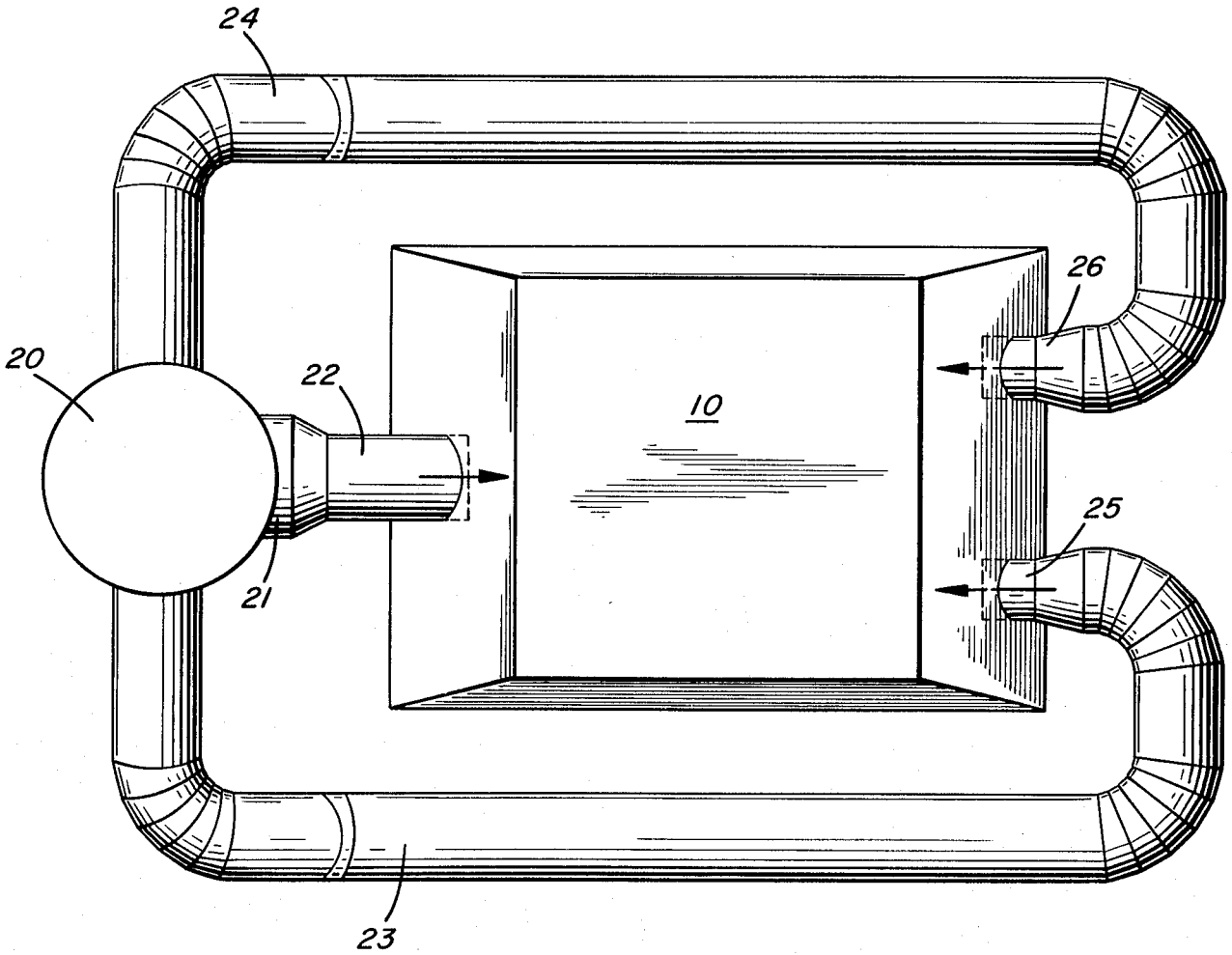
FIG. 1 is a plan view of a hood and pipework above a firing installation in an ore pelletizing plant.
Figure 2:
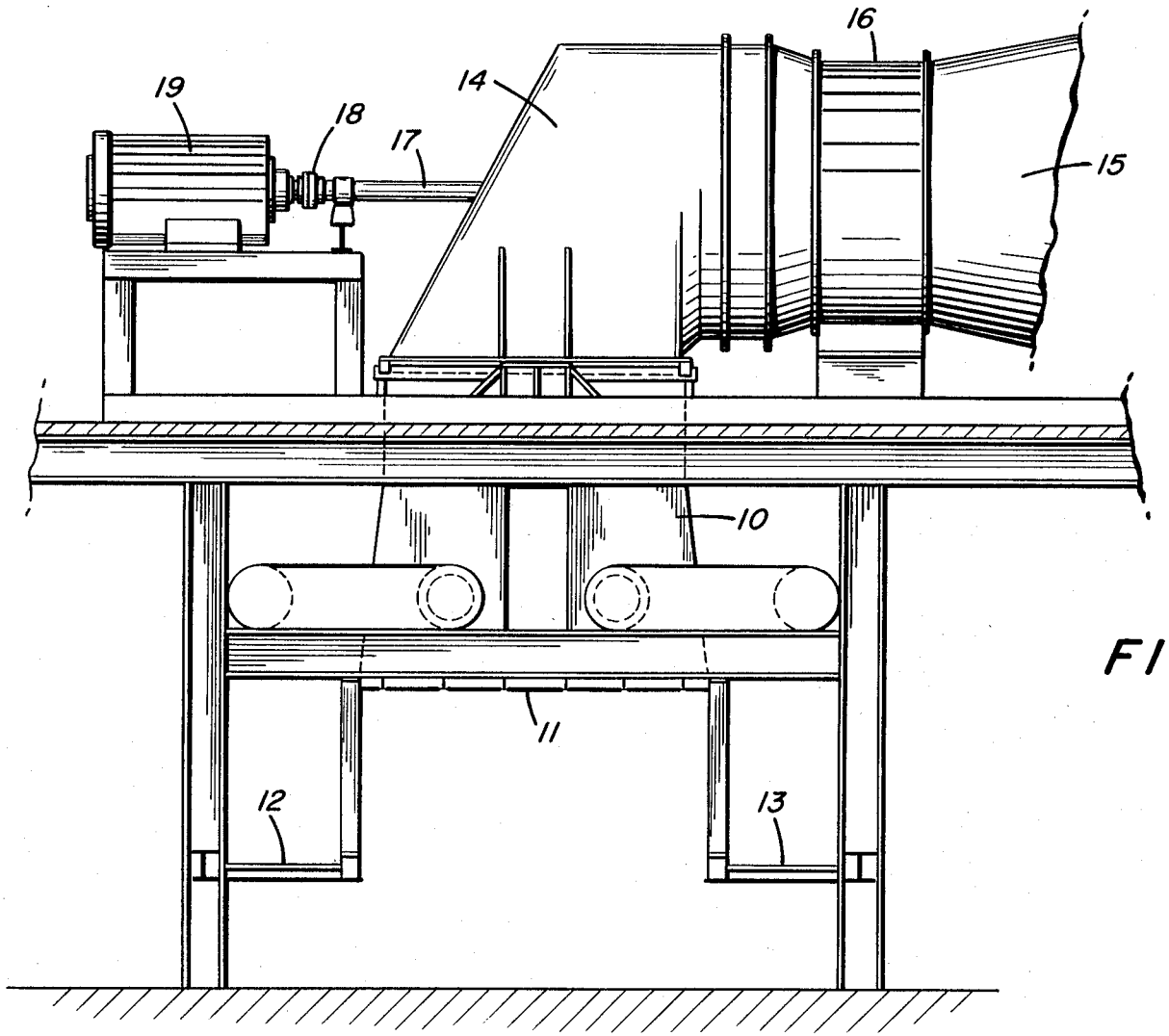
FIG. 2 is a side view of the apparatus of FIG. 1, showing further parts.

Referring first to FIGS. 1 and 2, in a pelletizing plant so-called "green" pellets are manufactured from crushed iron ore, a binder such as bentonite clay, lime and additional water. These "green" pellets must first be dried in the drying zone of a firing installation by heating with hot air before they are fired. Thereafter they are delivered to a blast furnace as ore pellets. FIGS. 1 and 2 illustrate a system embodying the present invention for the admixture of hot air at 300°–400° C. into a relatively cold (about 50° C.) airstream emerging from the drying zone which airstream is laden with $SO_2$ and is drawn off through a hood 10 located above the pellet conveyor 11 (FIG. 2). Access platforms 12,13 are shown on opposite sides of the pellet conveyor 11.

The hood 10 tapers upwardly, has a rectangular cross-section and is connected via a right-angle bend 14 to a cylindrical horizontal duct 15, in which an axial fan is located at the position 16. This fan is driven by an electric motor 19 via a shaft 17 and a flexible coupling 18.

Hot air at 300°–400° C. from another part of the pelletizing plant is supplied via a duct 20 to be admixed into the main flow of cool air passing through the hood 10. The air flow from the duct 20 is admitted into the hood 10 by a distribution system comprising three ducts 21,23,24, respectively connected through the walls of the hood by mouthpieces 22,25,26. The first distribution duct 21,22 carries about half the air flow in the duct 20 and directs the air perpendicularly through one side wall of the hood substantially at a longitudinal midplane of the hood (i.e. a plane perpendicular to the paper in FIG. 1). The other two distribution ducts 23,25 and 24,26 each carry about one-quarter of the flow in the duct 20, and each extend around the hood to open perpendicularly through the opposite side wall of the hood at points symmetrically offset with respect to the said midplane of the hood. The axes of the three openings 22,25,26 lie in the same transverse plane (parallel to the paper in FIG. 1). The flow into the hood from the first distribution duct 21,22 can thus be said to be radial while the flows from the other two distribution ducts are non-radial and opposed to but offset from the first flow so that two circulatory movement of the air being admitted, opposite in rotational sense, are set up in the hood (as seen in the direction of FIG. 1).

This method of mixing ensures that the gases are quickly and well mixed before they reach the fan 16, so that the fan corrodes less quickly and can operate for longer. The mixing distance can thus be very short, and within a short distance in the flow direction a rapid and efficient intermixing of two gases of different temperature is possible without requiring a voluminous and expensive construction and without a high expenditure of energy. The measured pressure loss is small, i.e. 0.35 times the velocity pressure loss in the main duct, which is very small.

Figure 3:
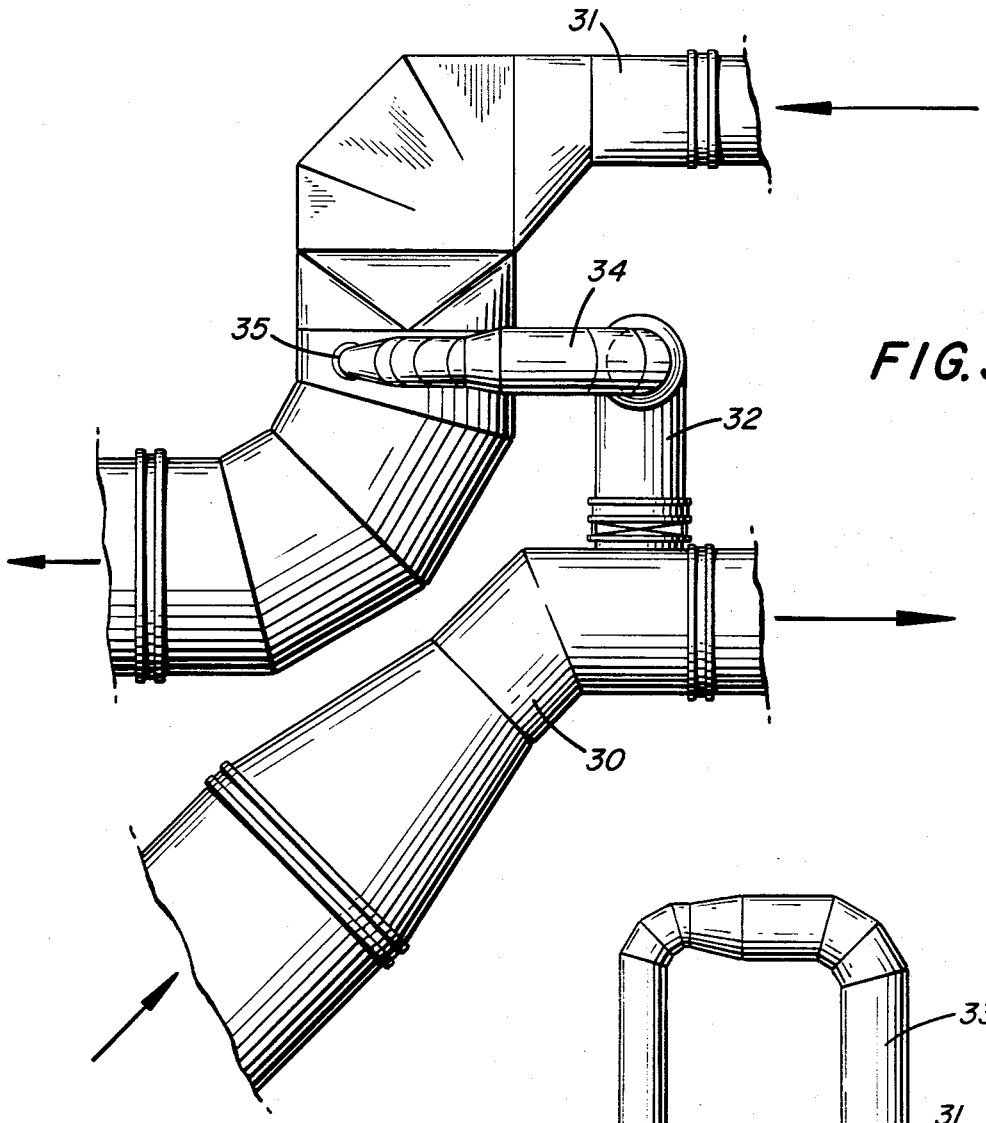
FIG. 3 is a side view of a gas mixing arrangement in an exhaust gas duct of an exhaust gas desulphurization plant.
Figure 4:
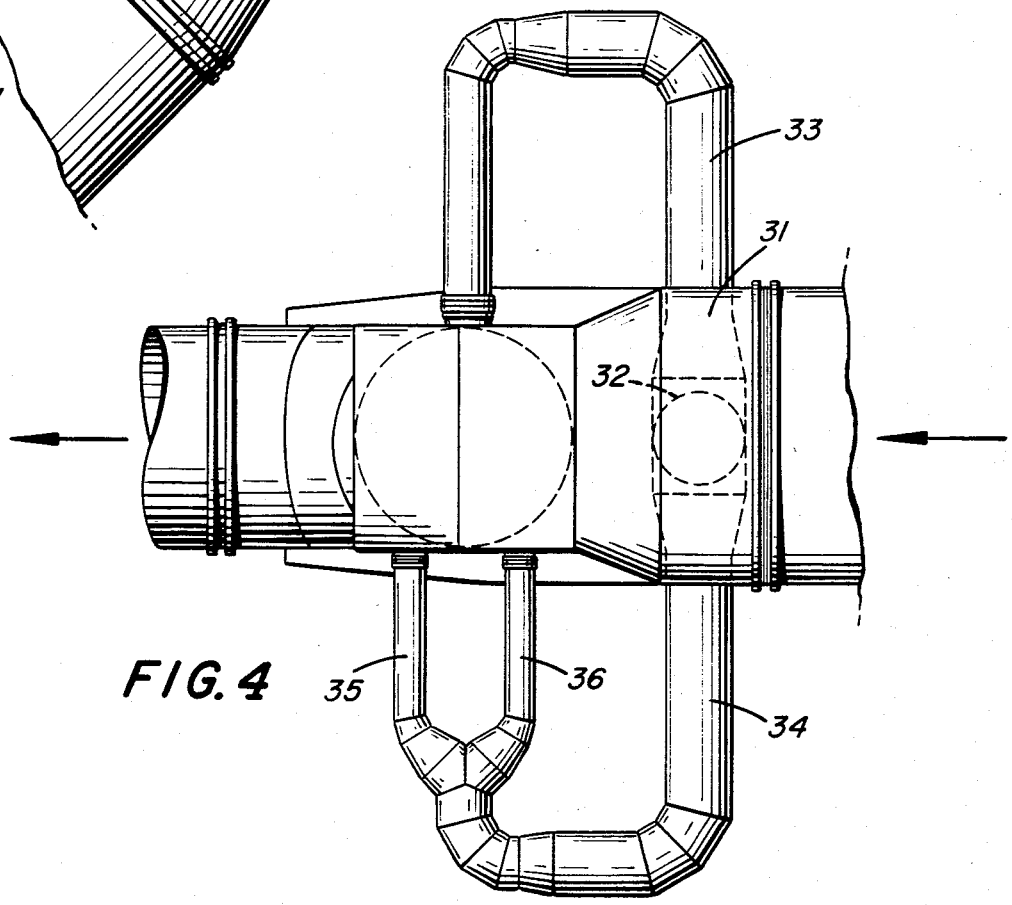
FIG. 4 is a plan view of the arrangement of FIG. 3.

Another application of the invention is in an exhaust gas desulphurization plant, this being illustrated in FIGS. 3 and 4.

The exhaust gases produced by a large electricity generating unit must, in accordance with present day requirements, be adequately desulphurized before being released into the atmosphere, and this desulphurization can be carried out by washing the gases in a so-called washing tower. The hot exhaust gases are there brought into contact with a counter-current of droplets of lime-containing water. The water carries away the sulphur oxides, and the calcium sulphate or gypsum which is thus produced can be utilized elsewhere.

The exhaust gases which have thus been stripped of sulphur are however saturated with water vapor, which may cause condensation on further transport through the ducts if the temperature falls below the dew-point. In order to increase the temperature of the treated exhaust gases by a few degrees, a portion (e.g. 10%) of the untreated gas from the duct 30 (FIG. 3) leading to the gas washer (not shown) is split off and added to the water-saturated gas flow in the duct 31 leading away from the gas washer.

The mixing of this split off gas flow into the larger flow in the duct 31 is carried out according to the present invention. For this purpose the branch duct 32 divides into two ducts 33 and 34, each carrying half the flow of the duct 32. The duct 33 opens perpendicularly through the wall of the duct 31 at a central axial plane thereof while the duct 34 is again divided into two ducts 35,36 carrying approximately equal flows which open, parallel and opposed to the duct 34, through the opposite side of the duct 31 at the same transverse plane. As in FIGS. 1 and 2, the openings of the two smaller ducts 35,36 are non-radial and offset relative to that of the duct 33, so that two mutually contra-rotating circulatory movements (vortices) of the gas being admitted are set up in the duct 31.

The quantity of hot exhaust gas tapped off by the duct 32 is thus quickly and effectively mixed into the main flow of treated exhaust gas in the duct 31 and raises its temperature by about 5° so that further transport of the treated gas through the duct 31 to a chimney at above the dew point is ensured. This addition of about 10% of hot sulphur bearing exhaust gas must be taken into account, in assessing the permissible release of the gas flow.

Figure 5:
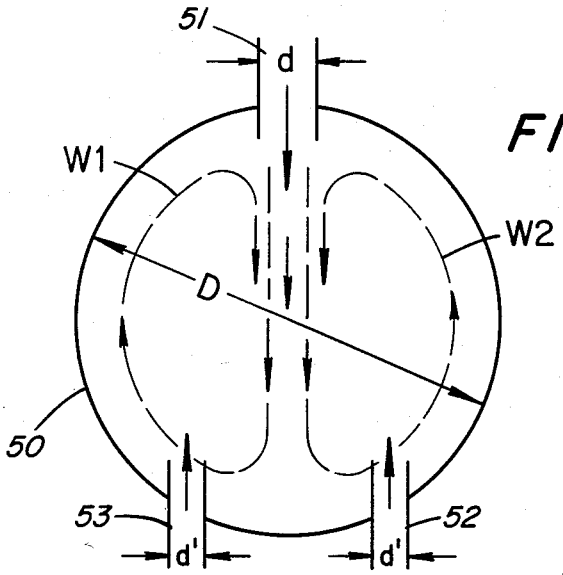
FIG. 5 is a schematic cross-sectional view of a main conduit illustrating, as one embodiment, the principle on which the present invention is based.

The principle on which the present invention is based is shown schematically in FIG. 5. This shows the wall 50 of a cylindrical main duct through which is carried a gas to which another gas is being added. This mixing may have to satisfy a number of requirements, such as the following:

the power required to effect the mixing process should be as low as possible, for reasons of energy conservation and minimizing noise nuisance;

the mixing must take place in as short a distance as possible along the axis of the main duct, and thus as quickly as possible, in order to keep investment costs in the apparatus as low as possible; the mixing must be as thorough as possible.

These requirements can be met well with the gas mixing arrangement shown in FIG. 5, in which the gas being added enters the main conduit 50 via openings at the ends of three supply conduits 51,52 and 53, which constitute a cooperating set.

The first supply conduit 51 is mounted radially with respect to the wall 50 and its outlet opening has a passage dimension such that about half the total quantity of the admixed gas enters through it. The two other supply conduits 52 and 53 are mounted parallel and opposed to the conduit 51 and in the same transverse plane. Their exit openings have a section area such that each transmits about a quarter of the gas being admixed. The conduits 52,53 are non-radial.

FIG. 5 shows that the two smaller conduits 52 and 53 have a symmetrical arrangement with respect to the line through the center of conduit 51. The desirable mutual separation of the two conduits 52 and 53 centre-to-centre is determined by the angle of the exit cone of the admixed gas in the main flow in the conduit 50, given that it is desirable to prevent any of the admixed gas from conduit 51 on the one hand and from conduits 52 and 53 on the other from blowing back into the other conduit(s). The exact intention is that these flows should influence each other so that two oppositely rotating main vortices are produced, as viewed in the axial direction (WI and W2 in FIG. 5), and these generate a very large mixing interface with the main gas stream. As is known for instance from the book "Verbrennung und Feuerungen" ("Combustion and Furnaces") by Dr. Ing. Rudolf Gunther, Springer 1974, the cone angle concerned is about 17°. The tangent of half this angle 17° is 0.15 so that, if all three conduits 51,52 and 53 have to have their exits as close to the wall as possible, the distance between the conduits 52 and 53 can be determined. If D is the internal diameter of the cylindrical main duct, the required distance must in all cases be greater than 0.3D. If the ratio of the internal diameter d of conduit 51 to the internal diameter D of the main duct 50 is about 0.1, the said distance is naturally correspondingly greater and is at least 0.4D.

Figure 6:
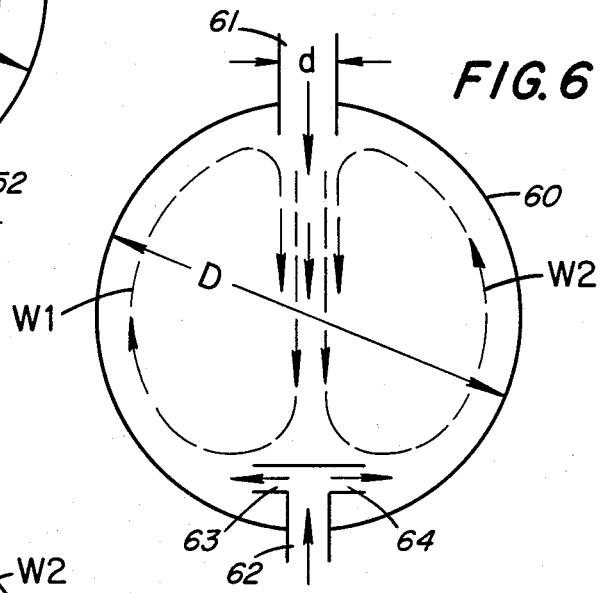
FIG. 6 is a schematic view which shows an embodiment of the invention which is a variant of that of FIG. 5.

Since it is the intention to obtain two vortices in the section through the main duct and thus two oppositely directed circulatory movements, it is also possible to combine the two smaller conduits (52 and 53) into one conduit with two outlet openings, thus again providing a set of three outlet openings. This variant is shown in FIG. 6. The wall of the cylindrical main duct is here indicated as 60. The supply conduit 61 opens radially through this wall and admits about half of the total quantity of admixed gas. Diametrically opposite to it there projects inward a supply conduit 62 which has a similar flow rate. This conduit 62 divides a T-shape into the two short sections 63 and 64 which have outlet openings at their extremities each admitting about a quarter of the quantity of admixed gas. These openings are tangentially directed. In this way again two mutually opposite circulatory movements W1 and W2 are produced in the admixed gas within the main duct.

Figure 7:
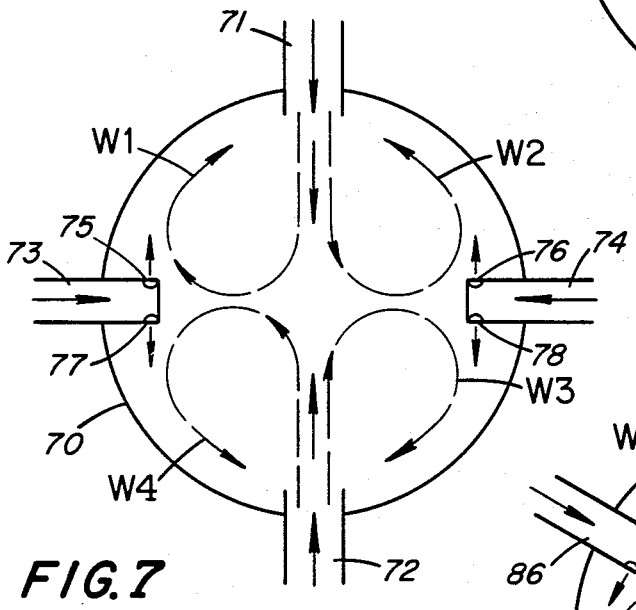
FIG. 7 is a schematic cross-section of a further variant of the invention having four supply conduits for the admixed gas into the main conduit.
Figure 8:
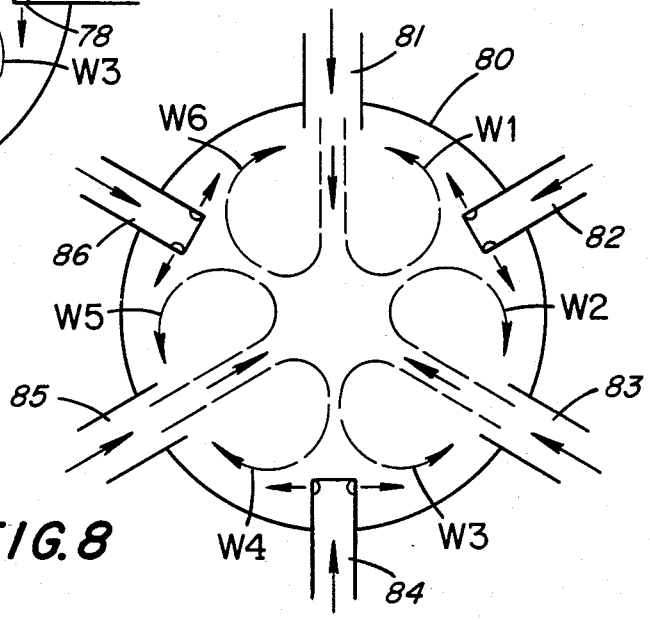
FIG. 8 is a schematic cross-section of yet another variant embodying the invention having six supply conduits for the admixed gas.

This principle can be extended and FIGS. 7 and 8 show further embodiments. By employing a larger number of groups of three outlet openings it is possible to increase the number of consecutively counter-rotating circulatory movements (vortices) of the admixed gas in the main flow and so achieve a proportionate reduction in the length along the main duct required to achieve complete mixing. For example, in certain circumstances it may be desirable to achieve mixing as quickly as possible in order to remove concentration or temperature differences.

FIG. 7 shows four supply conduits 71,72,73,74 protruding through the wall 70 of the cylindrical main duct at circumferential intervals of 90°, each with a passageway dimension such that it supplies about one quarter of the quantity of the admixed gas. Two mutually opposed supply conduits 73 and 74 are closed at their ends and have two tangential openings 75 and 77, and 76 and 78 respectively which are of equal size and each admit about half of the quantity of admixed gas passing through the conduit 73 or 74. The result is four circulatory motions or main vortices W1,W2,W3 and W4 which contribute to achieving that the mutual mixing of the two gases is even faster.

In FIG. 8, this principle is illustrated further by an embodiment providing a total of six vortices W1,W2,W3,W4,W5 and W6, allowing the mixing length along the axis to be shortened even further. This effect is achieved by mounting six radial supply conduits 81,82,83,84,85 and 86 in the main conduit wall 80 at mutual intervals of 60° each of them carrying the same flow quantity of gas being admixed into the main conduit. Alternate, these supply conduits opening radially and tangentially (parallel with the wall) in the manner already explained for FIGS. 6 and 7.

Tests have shown that with the embodiment according to FIG. 5 an acceptable mixing of the gas was obtained at a distance of 2D downstream from the plane in which the admixed gas was introduced.

If the variation coefficient (a dimensionless number) is defined as the quotient of the standard deviation and the mean, and if this is applied to the concentration of the mixture over the cross-section of the main stream in FIG. 5 at a distance downstream of the plane in which the admixed gas was injected, then it appears from measurements that a good mixing characterized by a variation coefficient of 0.04 at a distance of 2D and a somewhat better mixing with a variation coefficient of 0.02 at a distance of 4D can be obtained using this embodiment of the invention.

The invention can be applied successfully when two gases need thorough mixing rapidly and compactly. In addition to the applications already discussed with reference to FIGS. 1 to 4, namely for a firing installation for a pelletizing plant and for an exhaust gas desulphurization plant for an electricity generating unit, the invention can be applied to cooling towers, fuel supply arrangements for burners, etc.

WHAT IS CLAIMED IS:

1. In a conduit system having an arrangement for mixing a first gas into a main flow of a second gas, comprising a main conduit bounded by a wall for said main flow and a plurality of supply conduits for the first gas which open into said main conduit, the improvement that said supply conduits opening into said main conduit provide at least one set of three outlet openings for the first gas into the main flow, which set of openings consists of a first opening which opens into the main flow perpendicularly to the wall and two second openings which are arranged so as each to provide a lesser flow rate of the first gas in operation than said first opening and are offset with respect to said first opening so that the three openings of the set in operation direct the first gas into two contra-rotating circulatory movements, as viewed in the direction of the axis of the main conduit.

2. A conduit system according to claim 1 wherein in said set of openings said first opening is arranged to pass about one half of the quantity of first gas being admitted and each of said second openings is arranged to pass about one quarter of the quantity of first gas being admitted.

3. A conduit system according to claim 1 or claim 2 wherein there are three supply conduits respectively providing said three outlet openings of the said set, the outlet directions of the three openings being generally parallel.

4. A conduit system according to claim 1 or claim 2 wherein there are two of said supply conduits, one of which provides said first opening of the set of openings and the other of which terminates within the main conduit at two mutually oppositely directed openings which constitute said second openings and direct the gas flow generally tangentially with respect to said axis of the main conduit.

5. A conduit system according to one of claims 1 and 2 having a plurality of said sets of three openings.

6. A conduit system comprising a main conduit for a main flow of a gas having an axis and means for admixing a further gas into said main flow, said admixing means comprising a plurality of supply conduits having outlet openings for said further gas debouching into said main conduit, said outlet openings being arranged around the main conduit so as to provide at least one set thereof which consists of three outlet openings of which a first one debouches substantially radially with respect to the axis of the main conduit and the two others are adapted each to supply the said further gas at a flow rate which is less than the flow rate from said first outlet opening of the set, said second outlet openings being respectively arranged and located with respect to said first one so that in operation the three openings cooperate to direct the further gas into two mutually contra-rotating circulatory movements in said main conduit, as viewed in the axial direction of the main conduit.

* * * * *